US009764174B2

(12) United States Patent
Howard, Sr.

(10) Patent No.: US 9,764,174 B2
(45) **Date of Patent: *Sep. 19, 2017**

(54) RAIN MAKER WILDFIRE PROTECTION AND CONTAINMENT SYSTEM

(71) Applicant: John Wayne Howard, Sr., Allen, TX (US)

(72) Inventor: John Wayne Howard, Sr., Allen, TX (US)

( * ) Notice: Subject to any disclaimer, the term of this patent is extended or adjusted under 35 U.S.C. 154(b) by 49 days.

This patent is subject to a terminal disclaimer.

(21) Appl. No.: 14/309,108

(22) Filed: Jun. 19, 2014

(65) Prior Publication Data

US 2014/0299338 A1 Oct. 9, 2014

Related U.S. Application Data

(63) Continuation of application No. 13/068,268, filed on May 6, 2011, now Pat. No. 8,794,341.

(51) Int. Cl.
*A62C 27/00* (2006.01)
*A62C 3/02* (2006.01)
(Continued)

(52) U.S. Cl.
CPC ..... *A62C 3/0235* (2013.01); *A62C 3/02* (2013.01); *A62C 3/0214* (2013.01);
(Continued)

(58) Field of Classification Search
CPC ..... A62C 2/08; A62C 99/0072; A62C 25/00; A62C 3/02; A62C 27/00; A62C 3/0292; A62C 31/24
(Continued)

(56) References Cited

U.S. PATENT DOCUMENTS 3,727,841 A 4/1973 Hengesbach
3,779,461 A 12/1973 Paul
(Continued)

OTHER PUBLICATIONS

U.S. Appl. No. 13/068,268, Non-Final Office Action, Oct. 16, 2012.
(Continued)

*Primary Examiner* — Alexander Valvis
(74) *Attorney, Agent, or Firm* — Winston & Strawn LLP

(57) ABSTRACT

A mobile system and method of use thereof for containment of a fire event is provided in accordance with various embodiments of the current invention. The system herein designated "Rain Maker" is composed of a plurality of conduits with a manifold of fire nozzle connections in various configurations to discharge at extensive pressures specific fire suppressants. Each conduit can be operated individually, or connected to another conduit by a hose having a predetermined length forming a contiguous system thereby efficiently traversing large areas of land. The system can be operated either remotely as well as manually. An alternative embodiment can be installed in residential, commercial and industrial applications. Each system can be custom designed based on environmental engineering requirements and system application. The system components further have the capability of incorporating Global Positioning System (GPS), sensors, monitoring instruments, robotics, all terrain multi-purpose vehicles, satellite imaging and wireless technology.

20 Claims, 8 Drawing Sheets

Rain Maker 1

(51) Int. Cl.
*A62C 25/00* (2006.01)
*A62C 37/00* (2006.01)

(52) U.S. Cl.
CPC ..... *A62C 3/0292* (2013.01); *A62C 25/00* (2013.01); *A62C 27/00* (2013.01); *A62C 37/00* (2013.01)

(58) Field of Classification Search
USPC ... 169/13, 16, 17, 24, 48–50, 52, 66–68, 70; 239/200, 207, 210, 289, 550, 556, 558, 239/560, 561, 570
See application file for complete search history.

(56) References Cited

U.S. PATENT DOCUMENTS

| | | | | | |
|---|---|---|---|---|---|
| 3,931,931 | A | | 1/1976 | Otis | |
| 4,181,179 | A | | 1/1980 | Batte | |
| 4,836,291 | A | | 6/1989 | Owens et al. | |
| 4,875,526 | A | * | 10/1989 | Latino | A62C 27/00 169/24 |
| 5,113,946 | A | * | 5/1992 | Cooper | B62D 55/00 169/24 |
| 5,240,078 | A | * | 8/1993 | Worthington | A62C 5/02 169/14 |
| 5,467,827 | A | * | 11/1995 | McLoughlin | A62C 27/00 137/355.17 |
| 5,564,448 | A | | 10/1996 | Lincoln | |
| 5,632,341 | A | | 5/1997 | Allen | |
| 5,979,785 | A | * | 11/1999 | McKinney | F25C 3/04 239/14.2 |
| 6,065,693 | A | | 5/2000 | Lukas | |
| 6,085,586 | A | | 7/2000 | Arvidson et al. | |
| 6,719,065 | B2 | | 4/2004 | Baughman | |
| 7,028,783 | B2 | | 4/2006 | Celorio-Villasenor | |
| 7,066,414 | B1 | | 6/2006 | McGee et al. | |
| 7,225,999 | B2 | | 6/2007 | Foianini et al. | |
| 7,299,883 | B2 | | 11/2007 | Wielgat | |
| 7,644,776 | B2 | | 1/2010 | Holley et al. | |
| 7,756,621 | B2 | * | 7/2010 | Pillar | A62C 27/00 701/22 |
| 7,832,492 | B1 | | 11/2010 | Eldridge | |
| 7,966,941 | B1 | * | 6/2011 | Brannan | A63G 21/22 104/112 |
| 2006/0065411 | A1 | * | 3/2006 | Linsmeier | A62C 31/24 169/24 |
| 2006/0207659 | A1 | * | 9/2006 | Shaefer | F04B 23/04 137/355.2 |
| 2010/0071917 | A1 | | 3/2010 | Lalouz | |
| 2010/0175899 | A1 | | 7/2010 | Burkart | |
| 2010/0243281 | A1 | * | 9/2010 | Pazzaglia | A62C 3/02 169/47 |

OTHER PUBLICATIONS

U.S. Appl. No. 13/068,268, Final Office Action, Jul. 3, 2013.
U.S. Appl. No. 13/068,268, Non-Final Office Action, Nov. 20, 2013.
U.S. Appl. No. 13/068,268, Notice of Allowance, Apr. 30, 2014.

* cited by examiner

Rain Maker 1

Rain Maker 1A

21 Rain Maker all terrain utility vehicle

28,000 GPM Mobile liquid fire suppressant pump 16,000 GPM Mobile liquid fire suppressant pump 6,900 Gallon tank 21,000 Gallon mobile liquid fire suppressant storage tank System Flowchart Diagram of 21 all terrain utility vehicles surrounding a wildfire.

Automatic Fire nozzle

12

RAIN MAKER WILDFIRE PROTECTION AND CONTAINMENT SYSTEM

CROSS-REFERENCE TO RELATED APPLICATIONS

This application is a continuation of U.S. application Ser. No. 13/068,268 filed May 6, 2011, the entire content of which is expressly incorporated herein by reference thereto.

BACKGROUND OF THE INVENTION

1. Field of the Invention

The invention relates to a self-contained mobile, high tech, rapidly portable and deployable wildfire protection, containment and firefighting system and methods of use thereof.

2. Background—Description of the Prior Art

Wildfires are becoming extensively more devastating, as more people move to high risk wild land urban interface areas. As such, traditional methods of fighting wildfires known heretofore have demonstrated hampered efficacy from the initial time point, in which a fire has started, until it has been totally obliviated and has shown limited promise to the extent that would be desired. These ineffective conventional methods include fire suppression means comprising only a single hose and nozzle per fireman.

Particularly areas that exhibit lack of continuous rain, extreme heat, wind, hills, slopes, abundance of trees, dry arid conditions and an array of dry fuel sources comprising homes with roofs made up by wood that are located in close proximity to wild forest land create a dangerous combination for the initiation and spreading of wildfires.

In addition, the aforementioned sources in combination with ignition sources like for example lightning strikes, broken down power lines, or just simply human errors particularly create a very dangerous cocktail, in which, it has been extremely problematic to control and stop the inferno of a domino effect with traditional fire suppressing means presently known in the art.

Moreover, as traditional methods employ the inclusion of human work force power to wipe out wild fires, there also exists the undeniable risk of serious potential injury and death to fire fighters.

Thus it goes without saying that there is specifically a need for a paradigm change in the field of fire suppressing and containment systems, and accordingly, an urgency in the development of a device and system that overcomes the detrimental conditions observed heretofore associated with uncontrollable urban wildfires which is precisely what the current invention addresses.

Over the years a vast variety of sprinklers, spray nozzles, water fans and such other devices have been utilized for fighting and extinguishing wildfires.

As such, there exists a number of United States patents that display the general purpose of teaching sprinkling and spraying systems which will now be discussed in detail.

U.S. Pat. No. 3,727,841 generally teaches straight tubes comprising discharge ports distributed along their lengths and are detachably connected to form elongated dispensing pipe lines which are connectable at one end to a source of fluid under pressure and are plugged at the other end. The tubes are flexible transversely of their axes into curvilinear shapes ranging from about 6 inches upwardly by forces applied by the hands of a given operator, while the hands directly grip the tube. The tubes retain their normal cross sectional shape when so curved. They are constructed of a plastic material, such that they are self-restoring or readily restorable manually to original lineal condition by reverse bending by hand. The tubes are resistant to torsional deformation by manually applied forces and the coupling between the tubes hold the tubes so tightly, that an operator by applying rotational or torsional forces to any one of the tubes manually while gripping it directly in his hands, can rotate the entire line as a unit with each tube retaining its fixed rotated position relative to the others.

U.S. Pat. No. 3,779,461 specifically relates to an explosive blast actuated jet stream of liquid distributing assembly, which is transported by and located at or near and operatively connected to the location at which, its operation is desired for applying successive increments of water as a continuous stream, which extends distances from the end of that assembly for purposes of quelling riots and controlling fires.

U.S. Pat. No. 4,181,179 discloses a method and apparatus for suppression of an aircraft and airfield fire. An array of fire retardant nozzles interconnected to a fire retardant supply system make up the essential parts of the system and is provided alongside a runway of an airport and interconnected with a computerized control network for remote activation thereof. An array of different types of sensors unique functional parts of the systems, as well in combination with the retardant nozzle system for detecting heat of the type produced from an aircraft and runway fire or incident and permitting fire retardant responses thereto. The sensors are constructed in conjunction with orientation and angulation drive systems for positioning the separate fire-retardant nozzles in a configuration for spraying fire retardant upon the selected combustion. The system is provided with a smoke and fume evacuation system for use in combination therewith, whereby toxic by-products of aircraft fire may be removed from the vicinity of the fire hazard. Moreover the system comprises a laser integrated glide path response system for use in conjunction with the computerized network for activation in times of detected emergency.

U.S. Pat. No. 4,836,291 discloses a self-erecting portable sprinkler to effectively fight fires in oil refineries, petrochemical plants operated from a remote safe position. The portable sprinkler and process can help contain and extinguish fires in refineries and petrochemical plants while protecting firefighting personnel by setting up a spray mist and wall or curtain of water on the fire, as well as between the fire and firefighting personnel. The equipment and process help keep the fire from spreading by cooling the temperatures in the area surrounding the fire and minimize injuries to personnel by dissipating the toxic gases and smoke. A self-righting sprinkler is remotely placed in an upright erect position near the fire, while firefighting personnel stay away from the fire. The system is operated by moving the sprinkler to an upright erect position and simultaneously activating the sprinkler to spray a mist, curtain, and wall of water between the fire and firefighting personnel.

U.S. Pat. No. 5,564,448 is specifically concerned with a container washing apparatus for washing containers like beverage cans. An elongated liquid supply pipe comprises a plurality of angled fittings connected along opposite sides of the pipe. Each fitting includes a connect and a disconnect structure on its outer end for mating with the same structure of a fan spray nozzle. The fan spray nozzles may be turned onto the ends of the angled fittings in a twisting motion to align each of the elongated fan spray patterns parallel to one another and to the longitudinal axis of the pipe. The container washing apparatus is used in a washing system including a liquid permeable conveyor for moving a manifold of containers past a plurality of elongated spray pipes of the invention, which are mounted adjacent upper and lower sides of the conveyor in a perpendicular orientation relative to the movement of the conveyor.

U.S. Pat. No. 6,065,693 relates to a spray shower apparatus reconfigurable and adjustable for watering plants. The apparatus consists of a kit enabling modular assembly and enclosed within a common enclosure. The principal component of the kit is a rigid liquid conduit having at least one threaded end and a manifold of orifices disposed on the lateral wall of the conduit. The conduit has a plurality of spray nozzles attachable to the orifices of the liquid conduit. Each spray nozzle is adjustable as to the direction of spray relative to the liquid conduit. Other components of the kit include a connector for connecting the liquid conduit to an external source of liquid, brackets for securing the liquid conduit to a vertical environmental surface and an end cap for closing the distal end of the liquid conduit. Yet other components of the kit include a tee connector to accommodate branched arrangement of plural liquid conduits, a connector nipple enabling abutting connection of adjacent liquid conduits, threaded hose adapter fitting for connecting the liquid conduit to a garden hose or other source of liquid, and an adapter for enabling adjacent liquid conduits to be connected by slipping a garden hose over each conduit.

U.S. Pat. No. 6,719,065 generally exemplifies a fire fighting apparatus including a container with two tanks therein, wherein one of the tanks is used for holding a given quantity of water and the other for having a quantity of foaming agent, a pump which is operated by a gasoline engine, several hoses for directing a water and foam mixture at a fire and for refilling the water tank with water from a water encompassing source, and a valve system for directing the water and foam mixture through two different hoses at the fire, while the water from a source is used either directly on the fire, or for replacing water utilized from the tank. The apparatus is held within a container mounted on casters, such that it can be conveniently wheeled about. The unit is adapted for use in areas remote from fire departments.

U.S. Pat. No. 7,644,776 teaches a preassembled water transfer pipe for use in a fire fighting system, in which the water transfer pipe includes a generally hollow conduit member formed from a predetermined material and having each of a predetermined length and a cross sectional shape and a connection member equipped with a predetermined size connection for receiving a hose disposed at one end of the aforementioned hollow conduit member. Further, there is a pipe support assembly disposed at an opposite end of the hollow conduit member.

U.S. Pat. No. 7,832,492 discloses a portable fire suppression apparatus that has a conduit with an open end and a closed end. In some embodiments, the conduit is a combination of several similar conduits connected with couplings with the last conduit having a closed end. The conduit has a plurality of apertures disposed upon its length at distinct intervals. When a fire suppression agent is forced throughout the conduit, the medium streams from each aperture and drenches the surrounding area, and thereby provides a fire break and air borne spark suppression capability. The apparatus further includes means for stabilizing the conduit against rotation when high pressure medium is forced there through.

It is apparent from the presented prior art that there is generally an evident lack of a multipurpose deployable system and methods of use thereof in order to protect entire subdivisions, cities, towns, villages and the environment. Thus the limitations of the prior art are clear and would not offer much protection to fire fighters, high-rising mountainous regions or homes in wide-ranging and sweeping wildfire incidents. A desirable multipurpose deployable system would confer efficient fire suppression, containment and protection line covering extensive stretches of land that can either be remotely or manually controlled, such that fires with extensive reach are efficiently kept in check and thereby eliminated. Moreover there is further a crucial need in the prior art, where the construction and manufacture of such fire suppression systems consist of a heat resistant metal that is not readily vulnerable, and that can withstand the extensive temperature of the radiant and convection of heat and flames of the fire.

SUMMARY OF THE INVENTION

The present invention now provides a wildfire protection containment system and methods of use thereof that can be deployed by fire-fighting personnel. The system components create a novel method of protecting multi-story building structures, subdivisions and the environment from an approaching wildfire.

The novel invention provides with all its facets first responders with a cost effective remote controlled protection and containment solution to wild land urban interface fires. The combined system components designated "Rain Makers" are capable of providing protection to villages, towns, cities or rural communities adjacent to wild land urban interface environments through a method or technique called "layering".

Additionally the system incorporates modern digital instrumentation technology that transmits data from the fire zone to incident command, homeland security and fire fighters on the ground in the fire zone via sensors, monitoring devices, satellite imaging, GPS and other wireless devices.

Moreover the system incorporates zip line and grid track technology allowing the system to be elevated several stories above ground level thereby enabling a layering or rain effect on multi-story building structures.

In particular, the invention relates to a fire containment system comprising a cylindrical metal conduit having first and second ends, a longitudinal axis, and a hollow interior and open ends in fluidic communication with the hollow interior of the conduit; a quick-connect coupling connected to one open end of the conduit, with the coupling configured to selectively couple to an appropriate source of fire suppressant or to another conduit, and the other end of the conduit including one of a cap or a coupling connected to that open end of the conduit, with the coupling configured to selectively couple to an appropriate source of fire suppressant or to another conduit; a plurality of fire nozzles arranged upon and connected to the conduit in fluidic communication with the hollow interior of the conduit, wherein at least two nozzles are mounted on the fittings or nipples of the conduit at arched angles with respect to the conduit to spray and direct fire suppressant at the arched angles upwardly and away from the conduit with each nozzle being capable of delivering at least 75 gallons per minute when operatively associated with an appropriate source of fire suppressant and high pressure pumping equipment; and a structure operatively connected with the conduit for either preventing rotation of the conduit when spraying fire suppressant from the nozzles, or for suspending the conduit on an elevated zip line.

In this system, the at least two nozzles are preferably mounted on the conduit at arched angles of 40 to 45 degrees with respect to the conduit. Advantageously, at least two to four additional nozzles are arranged upon the conduit, with at least one additional nozzle arranged near each end of the conduit, with each nozzle being capable of delivering at least 75 gallons per minute when operatively associated with an appropriate source of fire suppressant and high pressure pumping equipment. The conduit typically has an inside diameter of 4 to 6 inches and includes a length of 40 to 48 inches, and the fire nozzles provide a predetermined spray pattern of fire suppressant when associated with high pressure pumping equipment and liquid fire suppressant, such that the suppressant can be dispersed into the atmosphere to create a rain-like effect in a contiguous 360 degree pattern.

The system may include a carrying handle secured to the conduit for transport thereof and a strobe light, reflective tape or glow in the dark paint associated with conduit for visual identification. Also, a bracket, containing a box may be provided that includes a digital instrumentation cluster, GPS, and sensors and monitoring devices associated on the conduit for wirelessly transmitting information from the conduit to assist in locating positioning.

In a most preferred arrangement, the plurality of nozzles include four nozzles present on a longitudinal cross-sections of the conduit and two nozzles near each end of the conduit. The plurality of fire nozzles are generally capable of delivering at least approximately in the range of 75 to 500 gallons per minute when operatively associated with an appropriate source of fire suppressant and high pressure pumping equipment.

In another embodiment, multiple conduits are combined to achieve the desired goal of protection and containment, with each conduit having forward and rear ends in fluidic communication with the hollow interior of the conduit, and a quick-connect coupling attached to each of the forward and rear ends of the conduit with each coupling configured to selectively couple to a cap, to an appropriate source of fire suppressant, or to another conduit. As many as 400 or more of the conduits may be connected by fire hoses to traverse thousands of linear feet over any type terrain.

When a zip line is used to deploy the conduit, the conduit typically includes a roller mechanism for engaging the zip line and allowing free movement of the conduit along the line. A plurality of utility vehicles can be provided and can be interconnected via zip line cables such that each mobile Rain Maker system for mountainous environments comprises at least four utility vehicles capable of completely surrounding a fire, whereby a highly efficient fire suppressant system is provided. The utility vehicle may be self-propelled and further comprising an open work platform, a telescoping hydraulic mast, a front way shovel, at least one articulated arm and a multitude of zip line cables and power winches efficiently allowing the system to be elevated above ground level. The system can be operated manually or remotely.

Another embodiment of the invention relates to a method for containing a fire which comprises arranging one or a plurality of conduits disclosed herein adjacent to a fire or in the path of a wildfire with the fire nozzles of the conduit directed towards the fire; providing fire suppressant to the conduit(s); and spraying and directing the fire suppressant upon or in front of the fire to prevent the fire from spreading. The fire suppressant can be a suppressant slurry, gel mix or water, and is sprayed at a high volume rates of at least 300 gallons per minute per conduit to starve the fire of fuel sources. The spraying of the fire suppressant comprises a layering technique so as to create a rain effect over large land areas at various locations by discharging the fire suppressant in an upwardly arched vertical spray pattern in a direction generally perpendicular to the plurality of the conduits. This layering technique comprises both ground level and above level spraying, with the fire suppressant sprayed at an angle of inclination towards the fire. In particular, the spraying of the fire suppressant provides a blanketing effect in which the fire suppressant is discharged skywards by the plurality of fire nozzles of the manifold of conduits at spraying high volumes comprising at least several thousand gallons per minute over at least a one mile land stretch.

DETAILED DESCRIPTION OF THE INVENTIVE EMBODIMENTS

The following definitions set forth the parameters of the current invention.

As used herein, the term "Rain Maker" refers to an apparatus, or a system incorporating the use of plurality of "Rain Makers" all characterized by the various embodiments of the present invention.

Figure 1:
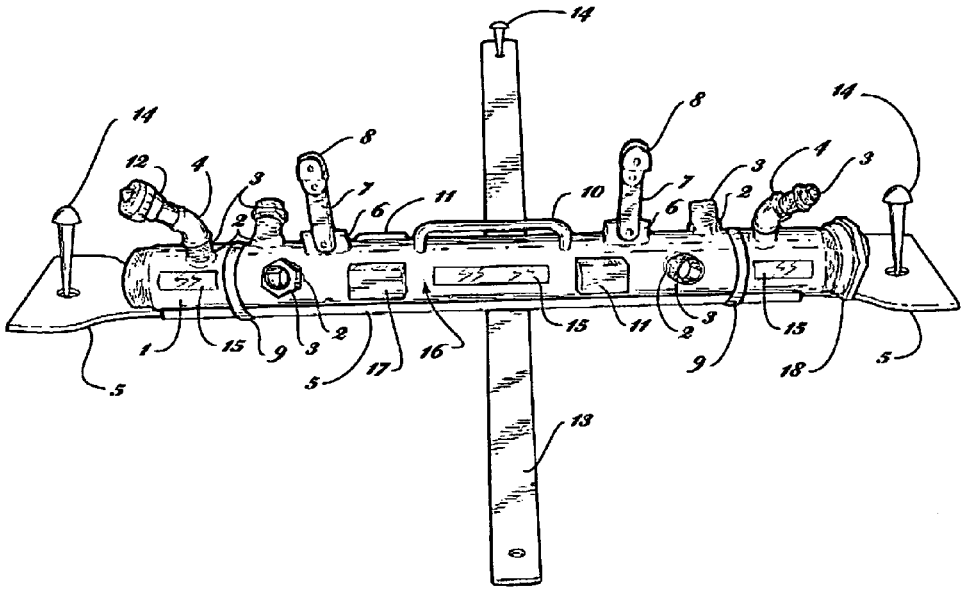
FIG. 1 is a perspective side view of a sprinkler conduit apparatus, the "Rain Maker" in accordance with one embodiment of the present invention.
Figure 1A:
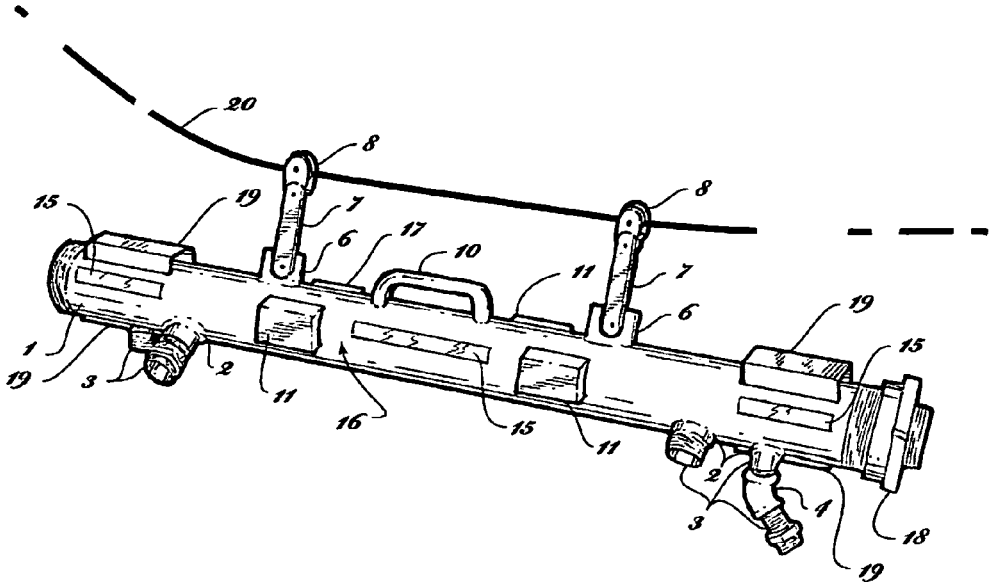
FIG. 1A is a perspective side view of a sprinkler conduit apparatus, the "Rain Maker" designed for overhead use only in accordance with principles of another embodiment of the present invention.
Figure 2:
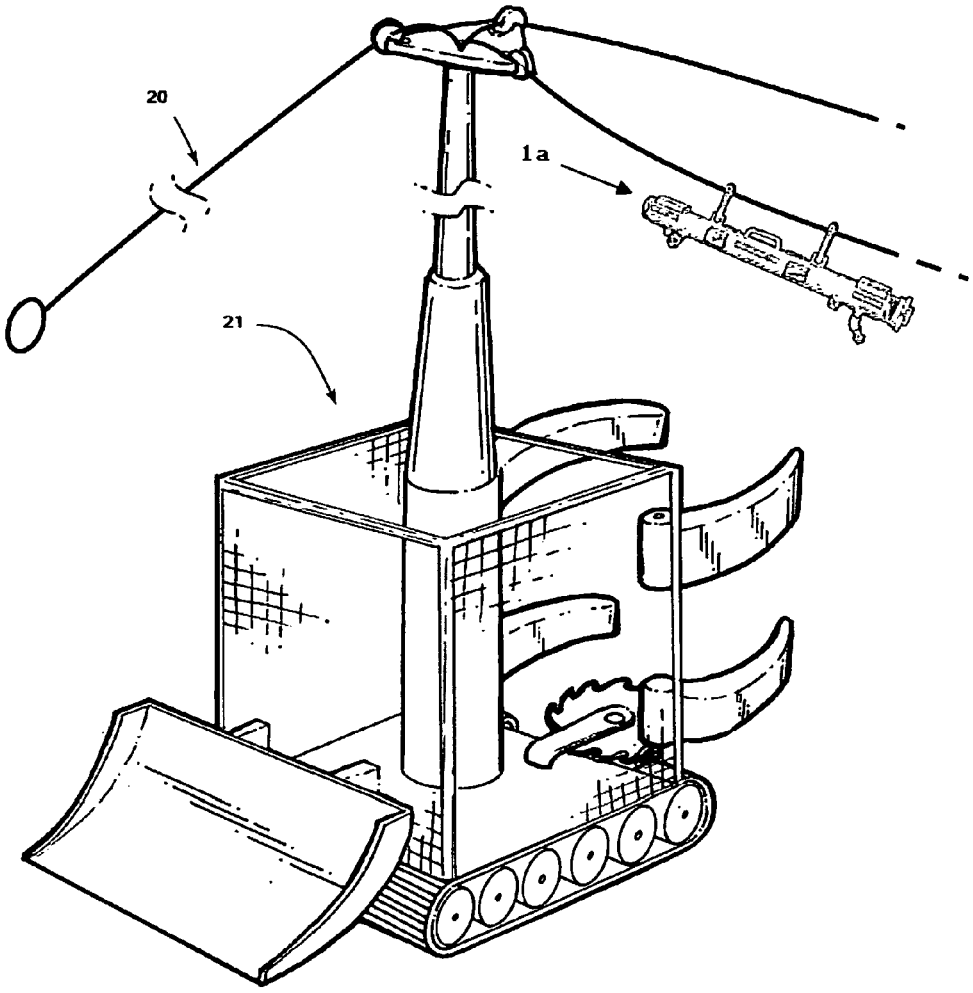
FIG. 2 is a perspective view of the "Rain Maker" all terrain multipurpose utility vehicle in accordance with another embodiment of the invention.
Figure 5:
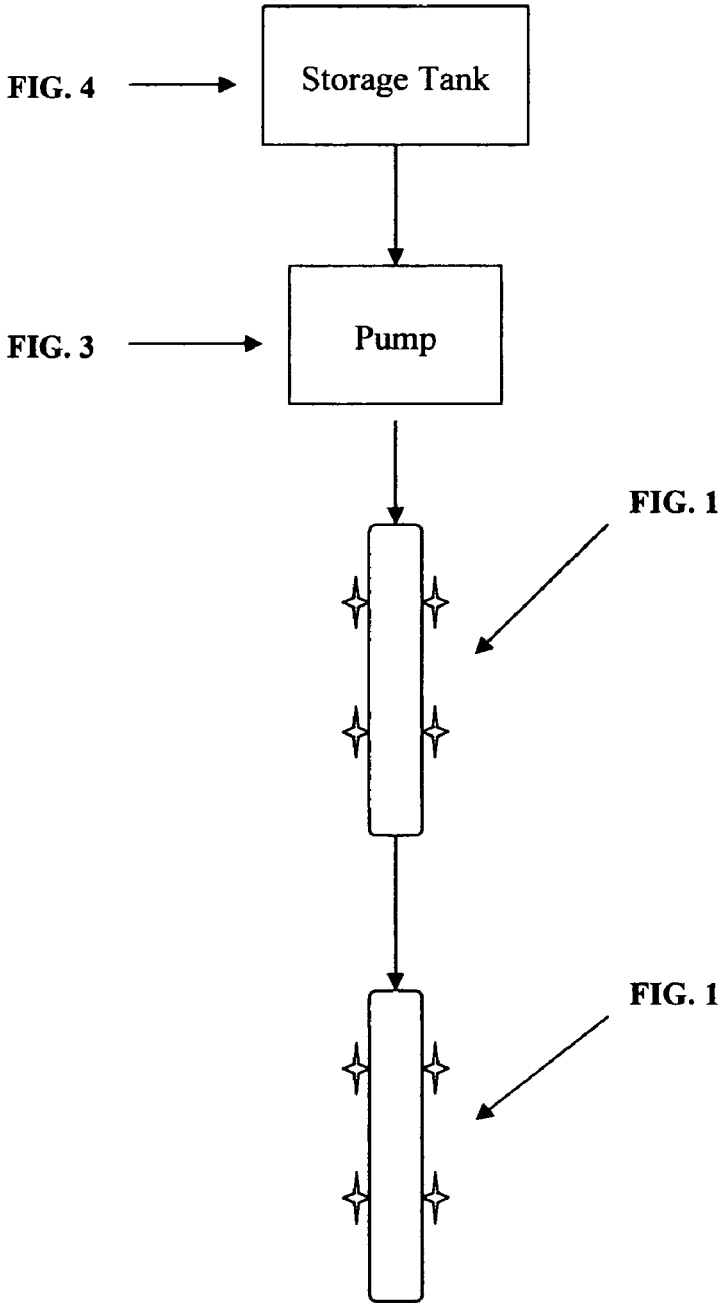
FIG. 5 is a schematic diagram representing how the "Rain Maker" system is connected to the pumps and storage tanks via fire hose in accordance with an embodiment of the present invention.
Figure 6:
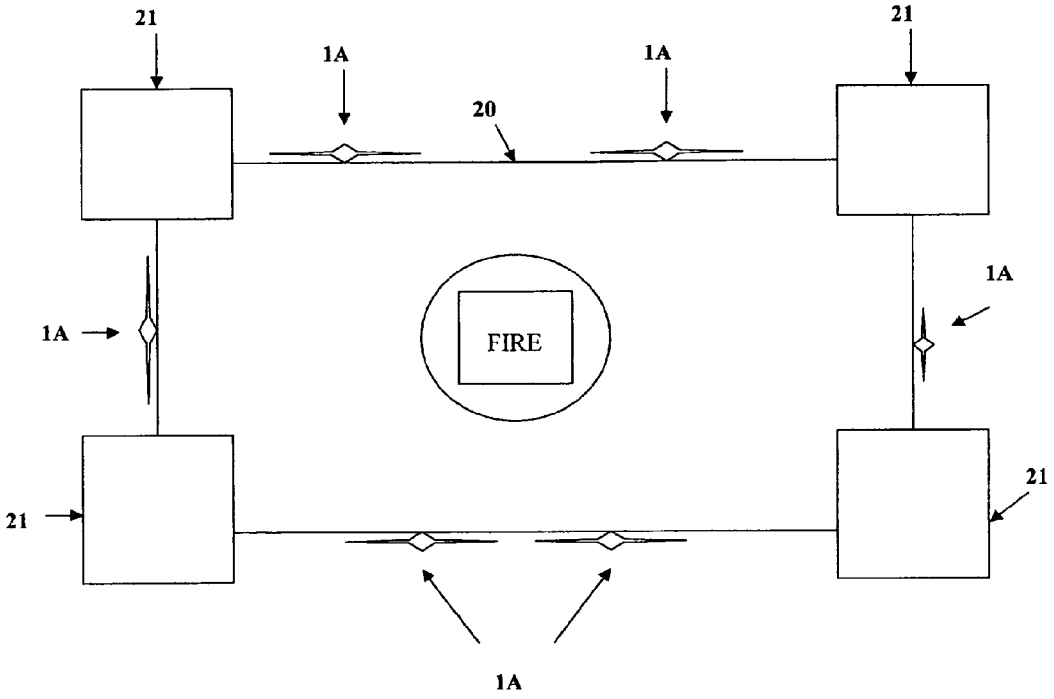
FIG. 6 is a schematic diagram depicting a system consisting of four "Rain Maker" apparatus all terrain multipurpose utility vehicles in combination with six "Rain Maker" conduit apparatus interconnected through zip line cables surrounding a fire exhibiting an overhead containment. The star symbols on the zip line cable represent the "Rain Maker" conduit apparatus of FIG. 1A.

Thus all depending on the distinct embodiments, "Rain Maker" may simply constitute a conduit apparatus as depicted in FIG. 1 and FIG. 1A, or may similarly be characterized by a whole system comprising the combination of different multiple individual "Rain Maker" devices as depicted in FIG. 2, FIG. 5 and FIG. 6.

Each "Rain Maker" device as demonstrated in FIG. 1 and FIG. 1A is characterized by having a reach of at least about 60-70 feet per side when operated with a pressure of at least approximately 120 psi in a 20 mph wind.

As used herein, the term "longitudinal" refers to the running lengthwise rather than across the width of a material.

As used herein, the term "cross section" refers to a surface or shape that would be exposed by making a straight cut through a physical object.

As used herein "axis" refers to a fixed reference line for the measurement of coordinates.

As used herein, the term "cylindrical" refers to a material having the form of a cylinder which is rounded and curved rather than jagged.

As used herein, the term "suppressant" refers to any agent or medium such as slurries, gel mixes or water which is sprayed at a rate of at least 300 gallons per minute per conduit for starving and treating a fire ignition point.

Figure 3:
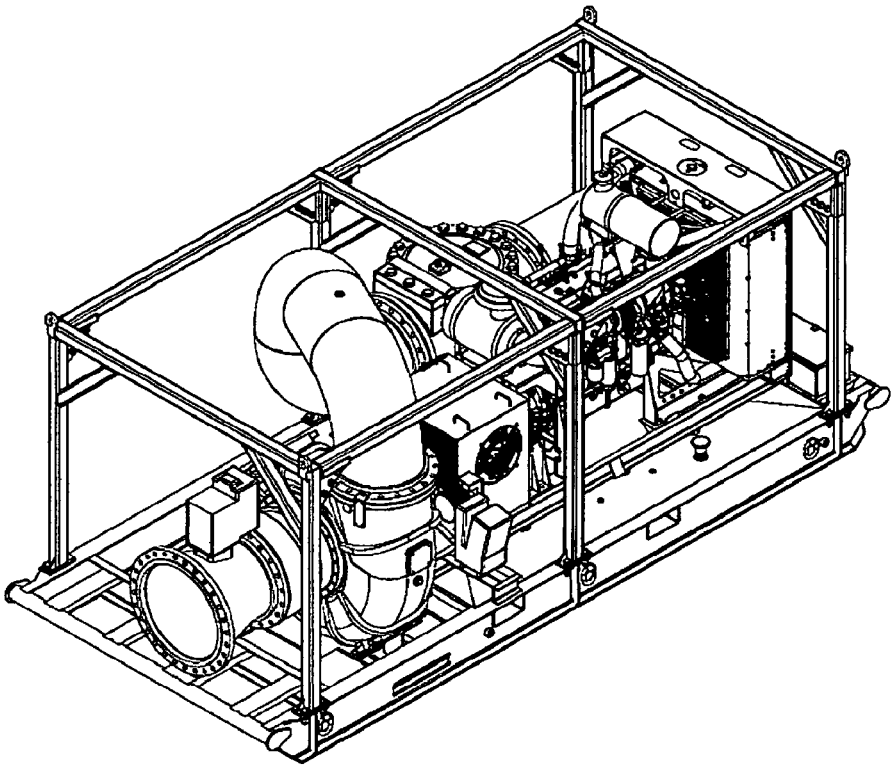
FIG. 3 is a perspective and side view respectively of high pressure and high volume diesel powered liquid pumps in accordance an embodiment of the invention.
Figure 3:
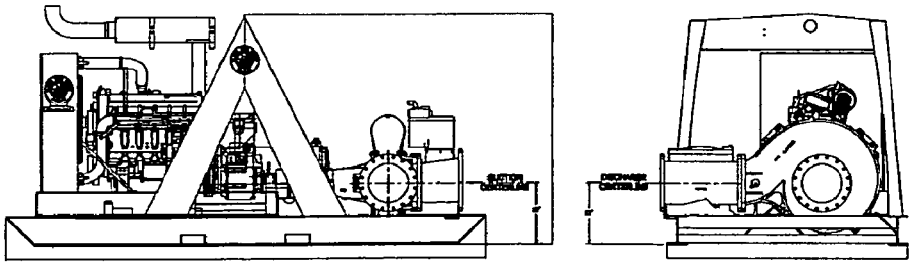
Figure 4:
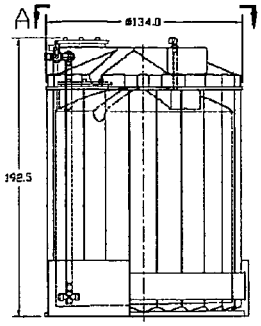
FIG. 4 is a front and perspective view of mobile storage tanks in accordance with an embodiment of the invention for delivery of fire suppressant to the pumps
Figure 4:
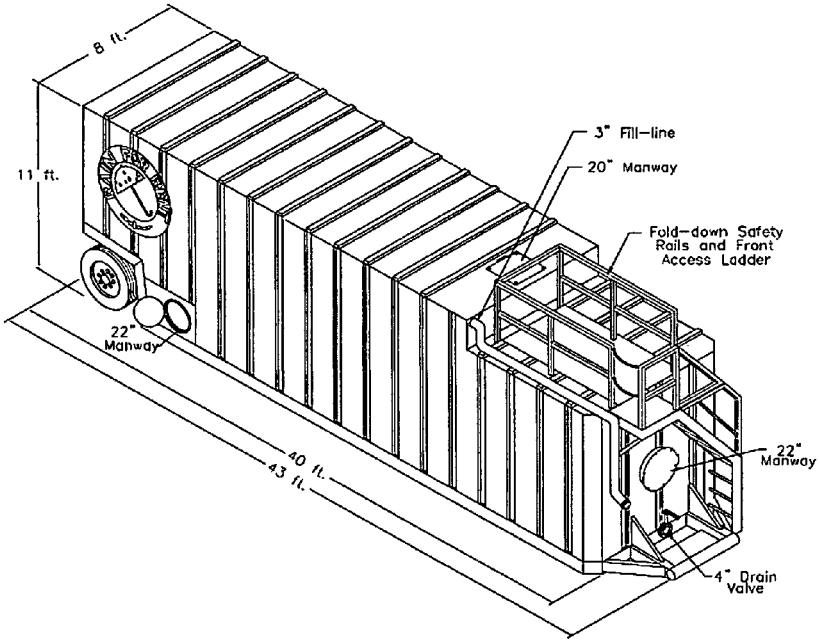

As used herein, the term "layering" refers to the deployment of complete preassembled "Rain Maker" equipment systems of FIG. 1 and FIG. 1A connected by fire hoses with a predetermined length to conduits, pumps and storage tanks as depicted in FIGS. 3 and 4 respectively, thereby effectively traversing thousands of linear feet over any type of rough terrain. "Layering" incorporates both ground level, as well as above level protection by deploying zip line components that can be built into the "Rain Makers" of FIG. 1 and FIG. 1A. The last "Rain Maker" of FIG. 1 is capped off at the end to build up pressure in the system forcing the suppressant to be discharged in a 360 degree pattern through a plurality of fire nozzles. On one side of the "Rain Maker" of FIG. 1 cross section, the suppressant is directed through fire nozzles toward the fire. On the opposite side, the nozzles are discharging toward the dry fuel vegetation or building structures, creating a one hundred eighty degree discharge pattern. "Layering" is designed to coat everything strategically and not sporadically. The "layering" technique can be an effective method of defense and prevention based on topography and other prevailing factors. All of the above mentioned creates the rain effect by discharging suppressant upwards towards a roof, walls of buildings or tree tops covering them completely, as well as vegetation and other potential fuel sources.

As used herein, the term "conduit" refers to a cylindrical material made of metal having first and second ends, a longitudinal axis, and a hollow interior and open ends in fluidic communication with the hollow interior of the conduit substantially formed as a channel for discharging and conveying water or other fluid.

As used herein, the term "nozzle" refers to a cylindrical or round spout used to control a jet of liquid or gas.

As used herein, the term "blanketting" refers to an effect that is achieved as the "Rain Maker" system of the present invention discharges fire suppressants skywards at extensive pressures and volumes of replace with several thousand gallons per minute over a one mile stretch at top end capacity through the unique design of the plurality of commercial grade large diameter fire nozzles.

As used herein, the term "containment" refers to the act to limit or prevent the expansion of a given event in the present case containing a wild fire.

As used herein, the term "Global Positioning System (GPS)" refers to a space-based satellite navigation system that provides location and time information in all weather conditions, anywhere on or near the Earth where there is an unobstructed line of sight to a plurality of GPS satellites As used herein, the term "pipe nipple" refers to a short piece cut from a pipe and is threaded in the construction of "Rain Makers" devices according to the current invention.

As used herein, the term "threading" refers to a substantially helical or spiral ridge on a screw, nut, pipe, or bolt.

As used herein, the term "sensor" refers to a device that responds to a physical stimulus such as wind, heat, light, sound, pressure, magnetism, or a particular motion and transmits a resulting impulse.

As used herein, the term "wireless" refers to the use of radio waves to send and receive electronic signals rather than the utilization of wires.

As used herein, the term "satellite" refers to is an artificial object which has been intentionally placed into orbit.

As used herein, the term "software" refers to non-tangible components of a computer, as opposed to "hardware" which is physical component of a computer.

As used herein, the term "robotics" refers to a technology dealing with the design, construction, and operation of robots in relation to automation.

As used herein "zip line" refers the use of an elevated cable winch system attached to the multi-purpose utility vehicles that allow the rain maker conduits to be deployed above ground to spray fire suppressant above the tree canopy and building structures.

In view of the foregoing and the description provided herein, the current specification of the instant application will clearly set forth the disadvantages inherent in the prior art heretofore such as systems being targeted solely to ground level fire suppression operation, and therefore do not specifically address situations pertaining to above ground level fire extinguishing operations.

Therefore these types of fire inhibition systems will only demonstrate limited efficacy in creating a fire break in a large open wind driven wild fire events, where the wild fires further reach to and climb trees and blow fire brands hundreds of feet into the air.

Thus the present invention provides a multi-purpose system and methods of use thereof for efficient fire suppression, layering and containment, whereby several immediately notable advantages over the prior art will be readily apparent from the discussion following herein below.

As such the first obvious advantage provided by the current invention with its various embodiments is the easy flexibility and mobility for rapid deployment along with its vast operating range of several square miles of deployment at ground level, as well as above ground level. The inherent advantage is due to the fact that the fire protection and containment system can be moved into place by truck or helicopter and can similarly be setup quickly without wasting any time, which is an essential parameter in order to most efficiently limit and control the spreading of wild fires.

Another immediate advantage is the incorporation of modern technology such as sensors, cameras, GPS and software technology such that fire fighters can have greater control and also receive more accurate real-time data and information about the wild fires movement and other conditions on the ground vital to their safety, and the safety of the community.

A yet further advantage of the present invention is the type of custom commercial grade fire nozzle used to construct the configuration of nozzles on each Rain Maker. The result of this important strategic technological advancement creates a heat resistant fire fighting system capable of efficiently extinguishing the fire by discharging suppressants at extensive pressures.

A yet another advantage of the instant is its light weight and can easily be managed, handled and maneuvered by fire fighters. Moreover, it is also highly heat resistant, and will therefore not melt by radiant and convection heat.

A further advantage of the type of fire nozzle design, and angle of placement on the invention makes it very robust when discharging fire suppressant at high pressures of around 120 psi being capable of reaching up to 5 stories from the ground, as confirmed by testing.

As the immediate advantages over the prior art has been set forth, the detailed description of the various embodiments of the invention will now be provided generally with reference to FIGS. 1-7.

However having said that, it should be clearly understood that these figures are merely provided as exemplary in nature and should therefore in no way serve to limit the scope of the invention, which is solely defined by the appended claims appearing herein below.

Thus in accordance with one embodiment of the invention, as best demonstrated in the perspective side view as depicted in FIG. 1 and FIG. 1A respectively, the Rain Maker pipe conduit 1 is a hollow preassembled cylindrical metal pipe consisting of a light weight heat resistant aluminum alloy with a predetermined diameter and length, which is threaded at each end to accommodate fire hose quick connect couplings and a cap on the lead unit to build up pressure in the system. Each Rain Maker pipe conduit 1 has an inside diameter of 4 to 6 inches and a length 40-48 inches long. Holes are subsequently cut along the longitudinal cross sections at certain points and angles thereby create thereon, such that a 360 degree discharge of the fire suppressant can be made possible, and to allow threaded pipe fitting 2 to be inserted and welded onto the Rain Maker pipe conduits 1 and 1*a*. Pipe nipples 3 are then threaded into pipe fitting 2. Adjustable fire nozzle 12 is then threaded onto all pipe nipples 3. Forty five degree female elbow 4 is threaded onto pipe nipple 3 on top at each end of the Rain Maker pipe conduit 1.

Figure 7:
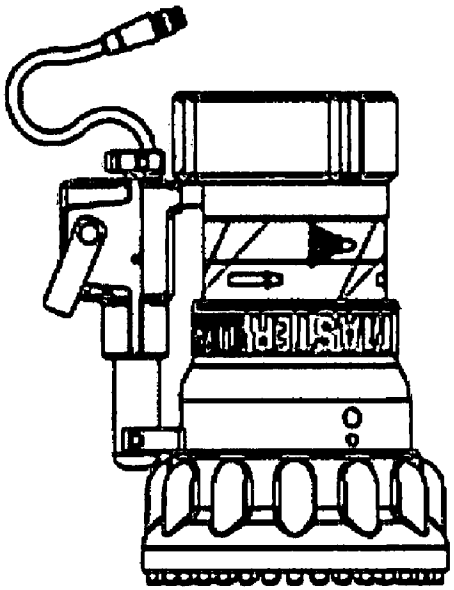
FIG. 7 illustrates a top-plan perspective view of the type of commercial grade combination fire nozzles that will be utilized on the "Rain Maker" as depicted on FIG. 1 and FIG. 1A respectively.

It should be noted that two additional male threaded pipe nipples 3 will be affixed on top of both ends of the Rain Maker pipe conduits 1 and 1*a* to add additional two fire nozzles 12 for a total of six-eight fire nozzles 12. FIG. 7 illustrates the type of commercial fire nozzle 12 that will be used in accordance with this embodiment of the invention in order to create a 360 degree discharge pattern with a preferred output range from 75 to 500 gallons per minute of fire suppressant thus fully ensuring the coverage all possible imaginable locations under fire.

Additionally, an automatic drain valve may be included in Rain Maker pipe conduit system 1 and 1*a* units to release any residual fluid and pressure stored in the conduits 1 and 1*a* (not shown in FIGS. 1 and 1A). The main pipe channel support base plate 5 is secured safely to the Rain Maker pipe conduit 1 by main pipe support channel base plate retainer clamp 9 and spot welded along the axis of the longitudinal cross section of Rain Maker pipe conduit 1 at main pipe support base plate 5 in (up to) four distinct places. Carry handle/strap 10 is secured to Rain Maker pipe conduit 1 by welding. High intensity strobe light 17 is secured to Rain Maker pipe conduit 1 through adhesive means. Bracket containing a box for sensors, monitors, GPS and wireless devices 11 is spot welded onto Rain Maker pipe conduit 1. Horizontal folding anchor plate 13 can be secured to bottom of base plate main pipe support channel base plate 5 by using spot weld. Main trolley support bracket 6 may welded to Rain Maker pipe conduit 1A. Trolley extension bracket 7 is bolted to main trolley support bracket 6 with ⅜ hex bolt and lock nut snug and tightened to allow extension bracket to fold down next to main body of Rain Maker pipe conduit 1 and 1*a*.

Zip line trolley wheel assembly 8 is attached to trolley extension bracket 7 by grade 8 bolts and lock nut. The Rain Maker pipe conduit assembly 1 and 1*a* are subsequently painted with glow in the dark paint 16. Reflective marking tape 15 is affixed in various locations on Rain Makerpipe conduit 1. Each preassembled Rain Maker can then be connected to another preassembled Rain Maker in a series via custom specialty heat resistant forestry fire hose of a predetermined length of approximately 100 feet long connected at each end of the plurality of rain makers, which ultimately cover distances of at least roughly one linear mile. This allows the system the flexibility to go anywhere in any type terrain creating a contiguous wall of fire suppressant in uniform coverage with a 360 degree spray pattern at predetermined arched angles on each fire nozzle 12 at 40 and 45 degree angles. The metal stakes 14 or sand bags can be used to anchor Rain Maker pipe conduits 1 to the ground when positioned on a paved or non-paved surface.

The Rain Maker pipe conduit 1*a* of FIG. 1A according to another embodiment is constructed almost in a similar fashion to the Rain Maker pipe conduit of 1 as illustrated in FIG. 1 utilizing all of the components of FIG. 1 except for the following items; main pipe support channel base plate 5, main pipe support channel base plate retainer clamp 9, horizontal folding anchor plate 13 and metal stakes 14, which are not required due to fact that the Rain Maker of FIG. 1A is solely dedicated to being used in conjunction with zip line deployment. This is primarily due to this version providing an alternative use in the layering technique mentioned above, as one of the overhead deployment technique is performed by using the Rain Maker all terrain multipurpose utility vehicle 21 in combination with the zip line cable 20, which follows herein below. The Rain Maker pipe conduit 1*a* includes a roller mechanism for engaging the zip line cable 20 and allowing free movement of the Rain Maker pipe conduit 1*a* along the zip line cable 20.

FIG. 2 demonstrates the Rain Maker all terrain multipurpose utility vehicle 21 in accordance with yet another embodiment of the present invention, which is a self-propelled mobile track utility vehicle having an open work platform, a telescoping hydraulic mast, a front way adjustable shovel, two articulated saw arms and multiple winches, cables, steering mechanism, tool storage, liquid storage tanks, high pressure pumps, a leveling system and a set of hydraulic grappling arms that anchor the vehicle around a suitable tree when needed during zipline deployment to prevent the vehicle from rollover when under load.

It further utilizes GPS, software, satellite and wireless technology to send data to incident command and ground troops in real time. It can be deployed on hill tops to clear brush and fuel loads as well as to deploy telescoping member above canopy trees. This is done in order to allow the Rain Maker to traverse zip line cable 20 in an overhead position to prevent canopy tree fires from advancing. Canopy tree fires are commonly referred to as ladder fires by fire service professionals. When using the Rain Maker all terrain multipurpose utility vehicle 21, it should be used to interconnect zip line cables 20 to each mobile unit 21 using multiple, e.g. two to four mobile units 21 in series that are situated 180 degrees opposite one another completely encircling and surrounding the wild fire as depicted in FIG. 6. When all components are connected, a number of suppressants can be deployed based on availability, vegetation and fuel load.

As described above, FIG. 3 depicts the mobile pumps used to connect the Rain Makers as shown in FIG. 1 and FIG. 1A to suppressant storage tanks of FIG. 4 through fire hoses as schematically diagrammed in FIG. 5.

Additionally the Rain Maker all terrain multipurpose utility vehicle 21 is capable of cutting down trees in a limited amount of time, as well as removing the tops and limbs interfering with deployment of the Rain Makers.

It also incorporates hydraulic leveling along with a hydraulic anchoring system that locks around a tree trunk to deploy mast and zip line cable 20 and Rain Maker of FIG. 1A.

In alternative embodiments of the Rain Maker system the design is preventive and preemptive in nature. In other words, the hardware can be permanently installed to existing or new infrastructure projects. Installing this system will prevent the spread of wildfire into the protected areas. It can be scaled to fit small and large applications, as exemplified by around any single family dwelling, entire subdivisions, villages, ecosystem sanctuaries, landmarks, oil refineries, power plants, nuclear reactors, oil drilling platforms, military installations, and schools to mention just a few. In order to accomplish this, the property would be measured and a Rain Maker system custom-designed and engineered to fit the size of the property and topography. A custom-designed system will take into account many factors to determine size and scale of the Rain Maker system components. Examples are such as inside diameter of conduit, size of fire nozzles, direction of trajectory, remote sensors, GPS, cameras, fully automatic and manual operation, pump sizes, and water points and other suppressants desired. Additionally mounting system on a grid, track/rail similar to a roller coaster rail or other type of constructed framework could be beneficial in high risk communities living with the threat of a possible deadly wildfire. A custom Rain Maker system would incorporate some of the same advanced technology as its commercial rapid deployment counter-part, i.e. sensors monitors and wireless technology and remote activation. Bringing these components together would provide a more robust self-contained external, monitored, fire protection system for single family and commercial buildings, nuclear reactors, on and off shore oil drilling platforms and refinery applications. The system would only depend on a municipal water supply to initially fill its storage tanks but draw from its own storage tank when the system is activated. A water feed line would automatically be activated to replenish storage tank when water level reaches a set point level.

In an emergency wildfire event usually the fire department would be the first responder. The invention will be deployed by the fire-fighting teams as demonstrated hereinbelow.

The Rain Maker self-contained wildfire protection system comprising the Rain Makers depicted in FIG. 1 and FIG. 1*a*, the pumps as demonstrated in FIG. 3 and the storage tanks as shown in FIG. 4 along with other accessories are transported to the fire scene by trucks or helicopters. A pre-staging deployment plan is developed based on all available data that are present in relation to the approaching fire, the area, topography, wind speed, fuel loads, vegetation and placement of homes and buildings and available water points such as but not limited to ponds, lakes, streams, canals or seas.

Once a pre-staging plan has been created, the fire fighters subsequently begin to deploy the Rain Maker system by connecting a plurality of Rain Makers as depicted in FIG. 1, such that a whole string constituting of four hundred or more Rain Makers are securely connected by using a fire hose with a predetermined length.

It is also possible to connect together in conjunction a plurality of Rain Makers 1 by a fire hose having a predetermined length if the Rain Makers 1 are staged on an unpaved surface, such that metal stakes 14 are driven through the horizontal anchor plate 13 and main pipe support channel base plate 5.

Further all depending on the characteristics of a given fire, as many as twenty-one thousand gallon storage tanks depicted in FIG. 4 are similarly staged as desired, and several four and five-inch fire hydrant hoses will accordingly feed into the abovementioned storage tanks of FIG. 4. Hydrants discharge water at various flow rates, such that it will be necessary to use multiple hydrants to feed each storage tank as demonstrated in FIG. 4. The smaller six-thousand nine hundred gallon storage tanks depicted in FIG. 4 are used solely in overhead deployments scenarios.

Moreover the storage tanks of FIG. 4 are also connected via the same fire hose to the pumps of FIG. 3, which are finally connected to the plurality of Rain Makers of FIG. 1.

Once all required system components have been properly connected as demonstrated in FIG. 5, the diesel and/or gas powered suppressant pumps as illustrated in FIG. 3 are started and initially checked for proper performance. When all checks have been performed, the green light is given by incident command to activate the Rain Maker system.

It follows that the fire fighters subsequently retreat to a safe location far away from the main fire event, in order to activate the pumps of FIG. 3, which then feed the Rain Makers as shown in FIG. 1. The Rain Makers subsequently discharge the fire suppressants with extreme pressures and high volumes covering all possible imaginable areas that are under immediate fire due to the unique design of the rain makers. Without being bound by theory and as a way of a preferred example, a blanketing effect is achieved the Rain Makers' discharge at pressures of roughly 128,000 gallons per minute over a one mile stretch at top end capacity through the commercial grade large diameter fire nozzle 12. This is made possible because of the fact that the pumps depicted in FIG. 3 can move and operate at least approximately 44,000 gallons per minute. Thus it follows that if at least three of such pumps are used in the connection of the whole staged Rain Maker system it equates to the abovementioned parameter.

Further, the unique construction of the Rain Makers of FIG. 1 makes it possible to release the suppressant in a 360 degree contiguous pattern covering everything within a 120 plus feet wide coverage area and more than at least four stories from the ground.

Because the system is flexible and multi-purpose in design comprising thousands of individual components, as many systems can be deployed as are required to create layering and containment barriers and protection to building structures wherever needed.

A yet another embodiment of the Rain Maker is depicted in FIG. 1A is specifically designed for use in an over-head attack position to contain wildfire in mountainous regions in which the operation of the system is as follows.

A pre-staging plan is developed by incident command using a service that provides satellite imaging and mapping combined with weather service data in the wildfire area. The preplan supplies the fire service command with invaluable information about where to deploy the Rain Maker system of FIG. 1A. All pre-staged Rain Maker components comprising the apparatus of FIG. 1 and FIG. 1A are stored in storage containers as demonstrated in FIG. 4 and equipped with airlifting apparatus totally equating not less than one hundred of the Rain Makers shown in FIGS. 1 and 1A. Along with hoses, pumps (FIG. 3), storage tanks (FIG. 4)

and other accessories, the tools are deployed by helicopter into a pre-planned staging area.

Once a suitable area is prepared, the system components are connected together by special fire hoses having a predetermined length, and Rain Makers of FIG. 1A are deployed onto zip line cable 20 and multiple Rain Makers of FIG. 1A are inter-connected by the fire hose. The telescoping hydraulic mast of the Rain Maker all terrain multipurpose utility vehicle 20 of FIG. 2 is raised to a desired height, and a plurality of Rain Makers of FIG. 1A connected in a series by a similar fire hose are deployed to traverse the zip line cable 20 above tree canopy. The string of Rain Makers are subsequently connected to the storage tanks of FIG. 4, which are hooked up to the pumps of FIG. 3 via the fire hose. The string of Rain Makers is deployed by a crawler winch device above canopy trees ahead of the wildfire. Once in position, the Rain Maker system is activated to discharge fire suppressant with such a force that is capable of releasing suppressant in directions characterized by 60-80 foot wide, in which all fire nozzles 12 discharge simultaneously from both sides and bottom of the Rain Makers demonstrated in FIG. 1A.

A contiguous application of suppressant is blown at a rate of at least 300 gallons per minute per conduit into the canopy tree foliage and ground fuels to treat with water or other chemical slurry. This new method would coat fuel sources ahead of approaching fire, literally creating a containment line by starving the fire of its fuel source much like air tankers dropping suppressant ahead of a wildfire to stop it from spreading. This new system and method can be added as an additional tool to the fire service to contain and control the spread of wild fire by boxing it into a containment zone. Surrounding the fire using the method described, fire fighters can now obtain 100% containment faster on big fires. The Rain Maker all terrain multipurpose utility vehicle 20 of FIG. 2 can be used in a variety of topographical environments including flat terrain paved and non-paved areas. The Rain Maker system comprising sensors and monitors will communicate real time data to incident command, as well as providing GPS tracking data of assets deployed, temperatures and ambient conditions in the fire zone.

What is claimed is:

1. A fire containment system comprising:

a first, cylindrical metal conduit having first and second ends, a longitudinal axis, and a hollow interior and open ends in fluidic communication with the hollow interior of the first conduit, the conduit including fittings or nipples;

a quick-connect coupling connected to one open end of the first conduit, with the coupling configured to selectively couple to a source of fire suppressant or to another conduit, and the opposite end of the first conduit including one of a cap or a coupling connected to that open end of the first conduit, with the coupling configured to selectively couple to the source of fire suppressant or to another conduit, with one of the couplings coupled to the source of fire suppressant;

a plurality of fire nozzles arranged upon and connected to the first conduit in fluidic communication with the hollow interior of the first conduit, wherein the plurality of fire nozzles are mounted on the fittings or nipples of the first conduit at arched angles with respect to the first conduit to spray and direct fire suppressant at the arched angles upwardly and away from the first conduit with each nozzle being capable of delivering at least 75 gallons per minute when operatively associated with the source of fire suppressant and high pressure pumping equipment; and a structure operatively connected with the first conduit for preventing rotation of the conduit when spraying fire suppressant from the nozzles, with the structure comprising a main pipe channel support base plate having first and second ends and secured orthogonally to the first conduit so that the base plate ends are perpendicular to the first conduit.

2. The system of claim 1, wherein the at least two nozzles are mounted on the conduit at arched angles of 40 to 45 degrees with respect to the first conduit.

3. The system of claim 1, including at least four additional nozzles arranged upon the first conduit, with at least one additional nozzle arranged near each end of the first conduit, with each nozzle being capable of delivering at least 75 gallons per minute when operatively associated with the source of fire suppressant and the high pressure pumping equipment.

4. The system of claim 3, wherein the first conduit has an inside diameter of 4 to 6 inches and includes a length of 40 to 48 inches, and the fire nozzles provide a predetermined spray pattern of fire suppressant when associated with the high pressure pumping equipment and fire suppressant, such that the suppressant can be dispersed into the atmosphere to create a rain-like effect in a contiguous 360 degree pattern.

5. The system of claim 1, further comprising a carrying handle secured to the first conduit for transport thereof and a strobe light, reflective tape or glow in the dark paint associated with first conduit for visual identification.

6. The system of claim 1, further comprising a bracket containing a box that includes a digital instrumentation cluster, GPS, and sensors associated on the first conduit for wirelessly transmitting information from the first conduits closest to the fire zone to an incident command center to assist in real time decision making as well as locating assets positions.

7. The system of claim 1, wherein the plurality of nozzles include four nozzles present on a longitudinal cross-section of the first conduit and two nozzles near each end of the first conduit.

8. The system of claim 1, wherein the plurality of fire nozzles are capable of delivering in the range of 75 to 500 gallons per minute when operatively associated with the source of fire suppressant and the high pressure pumping equipment.

9. The system of claim 1, wherein multiple first conduits are combined to achieve the desired goal of protection and containment.

10. A method of containing a fire comprising a fire containment system according to claim 1, the method comprising:

arranging one or a plurality of first conduits adjacent to a fire or in the path of a wildfire with the fire nozzles of the first conduit(s) directed towards the fire;

providing fire suppressant to the first conduit(s) and spraying and directing the fire suppressant upon or in front of the fire to prevent the fire from spreading.

11. The method of claim 10, wherein the fire suppressant is a suppressant slurry, gel mix or water, and is sprayed at a rate of at least 300 gallons per minute per first conduit to starve the fire of fuel sources.

12. The method of claim 10, wherein spraying the fire suppressant comprises a layering technique so as to create a rain effect by discharging the fire suppressant in an upwardly vertical spray pattern in a direction generally perpendicular to the one or a plurality of first conduits.

13. The method of claim 12, wherein the layering technique comprises both ground level and above ground level spraying.

14. The method of claim 10, wherein the fire suppressant is sprayed at an angle of inclination towards the fire from a location in proximity to the ground.

15. The method of claim 10, wherein spraying the fire suppressant provides a blanketing effect in which the fire suppressant is discharged skywards by the fire nozzles of a manifold of the one or a plurality of first conduits.

16. A fire containment system comprising:

an elevated zip line suspended above an area that is to receive fire suppressant;

a first, cylindrical metal conduit having first and second ends, a longitudinal axis, and a hollow interior and open ends in fluidic communication with the hollow interior of the first conduit, the first conduit including fittings or nipples;

a quick-connect coupling connected to one open end of the first conduit, with the coupling configured to selectively couple to a source of fire suppressant or to another conduit, and the opposite end of the first conduit including one of a cap or a coupling connected to that open end of the first conduit, with the coupling configured to selectively couple to the source of fire suppressant or to another conduit, with one of the couplings coupled to the source of fire suppressant;

a plurality of fire nozzles arranged upon and connected to the first conduit in fluidic communication with the hollow interior of the first conduit, wherein the plurality of fire nozzles are mounted on the fittings or nipples of the first conduit at arched angles with respect to the first conduit to spray and direct fire suppressant at the arched angles upwardly and away from the first conduit with each nozzle being capable of delivering at least 75 gallons per minute when operatively associated with the source of fire suppressant and high pressure pumping equipment; and a roller operatively connected with the first conduit for suspending the conduit on the elevated zip line;

wherein the first conduit is attached via the roller to the zip line.

17. The system of claim 16, wherein the roller allows free movement of the first conduit along the zip line and wherein the plurality of fire nozzles are mounted on the first conduit at arched angles of 40 to 45 degrees with respect to the conduit.

18. The system of claim 16, further comprising a plurality of utility vehicles, in which the plurality of utility vehicles are interconnected via the zip line such that each mobile unit comprises at least four utility vehicles capable of surrounding the area to provide an efficient fire containment system.

19. The system of claim 18, wherein the utility vehicle is self-propelled and further comprising an open work platform, a telescoping hydraulic mast, a front way shovel, and at least two articulated saw arms.

20. The system of claim 16, further comprising an incident command center, a bracket associated with first conduit (s) and containing a box that includes a digital instrumentation cluster, GPS, and sensors associated on the first conduit(s) for wirelessly transmitting information from the first conduit(s) to the incident command center to assist in real time decision making as well as locating assets positions.

* * * * *